US008936257B2

(12) United States Patent
Kinnee

(10) Patent No.: US 8,936,257 B2
(45) Date of Patent: Jan. 20, 2015

(54) MOBILE STORAGE UNIT WITH A RETRACTABLE WHEEL MECHANISM

(75) Inventor: Bruce Kinnee, Pleasanton, CA (US)

(73) Assignee: Zuca, Inc., Milpitas, CA (US)

( * ) Notice: Subject to any disclaimer, the term of this patent is extended or adjusted under 35 U.S.C. 154(b) by 308 days.

(21) Appl. No.: 13/116,929

(22) Filed: May 26, 2011

(65) Prior Publication Data

US 2012/0299257 A1 Nov. 29, 2012

(51) Int. Cl.

| | |
|---|---|
| ***B62B 1/12*** | (2006.01) |
| ***A45C 5/14*** | (2006.01) |
| *A45C 9/00* | (2006.01) |

(52) U.S. Cl.

CPC ..... *A45C 5/146* (2013.01); *A45C 2009/002* (2013.01)

USPC ..... 280/43.1; 280/47.17; 16/44

(58) Field of Classification Search

USPC ..... 280/47.131, 47.15, 47.17, 47.18, 47.21, 280/47.22, 47.26, 43, 43.1; 16/19, 45, 32, 16/33, 35 R, 44; 301/5.304, 111.05

See application file for complete search history.

(56) References Cited

U.S. PATENT DOCUMENTS

| | | | | |
|---|---|---|---|---|
| 1,155,475 | A | | 10/1915 | Fay |
| D131,210 | S | | 1/1942 | Moreing |
| 2,277,302 | A | | 3/1942 | Chennette |
| 2,374,278 | A | | 4/1945 | Fuerstenberg |
| 2,439,992 | A | | 4/1948 | Simonian |
| D152,576 | S | | 2/1949 | Wallace |
| 2,472,491 | A | * | 6/1949 | Quinton ..... 280/37 |
| 2,710,084 | A | | 6/1955 | Braverman |
| 2,758,847 | A | | 8/1956 | Shone |
| 2,759,738 | A | | 8/1956 | Reiter |
| 2,778,654 | A | | 1/1957 | Gottlieb |
| D180,868 | S | | 8/1957 | Diehl |
| 2,835,503 | A | | 5/1958 | Humphries et al. |
| 2,842,373 | A | | 7/1958 | Duerr |
| 2,874,813 | A | | 2/1959 | Bunte |
| 2,905,480 | A | | 9/1959 | Giovannelli |
| 2,957,700 | A | | 10/1960 | Beaurline |
| 3,420,540 | A | | 1/1969 | Bird |
| 3,460,850 | A | | 8/1969 | Franklin |
| D222,933 | S | | 2/1972 | Brown |
| 3,669,463 | A | | 6/1972 | Boudreau |
| 3,677,571 | A | | 7/1972 | Maturo, Jr. et al. |
| 3,684,307 | A | | 8/1972 | Bourgraf et al. |
| 3,759,538 | A | | 9/1973 | Fabiano |
| 3,782,752 | A | | 1/1974 | Gobetz |
| 3,829,113 | A | | 8/1974 | Epelbaum |
| 3,994,372 | A | | 11/1976 | Geller |

(Continued)

FOREIGN PATENT DOCUMENTS

| | | |
|---|---|---|
| CA | 2484901 A1 | 12/2003 |
| DE | 4221215 A1 | 1/1994 |

(Continued)

*Primary Examiner* — John Walters
(74) *Attorney, Agent, or Firm* — Haverstock & Owens LLP

(57) ABSTRACT

A mobile storage unit comprises a rigid frame coupled with a top seat portion, a pair of wheels and a number of supports. The wheels are coupled to a wheel mechanism that retracts the wheels into a retracted position when a downward force is applied to the rigid frame in an upright position. As a result, at least one supplemental support that is positioned above the ground when the pair of wheels are in the extended position, touches the ground when the pair of wheels is in the retracted position thereby adding support and stability to the mobile storage unit when in the upright position.

38 Claims, 10 Drawing Sheets

(56) References Cited

U.S. PATENT DOCUMENTS

| | | | | |
|---|---|---|---|---|
| 3,997,213 | A | 12/1976 | Smith et al. | |
| 4,017,092 | A | 4/1977 | Boomer | |
| D252,264 | S | 7/1979 | Paterson | |
| 4,165,088 | A | 8/1979 | Nelson | |
| 4,247,130 | A | 1/1981 | Paterson | |
| 4,290,625 | A | 9/1981 | Barriere | |
| 4,350,366 | A | 9/1982 | Helms | |
| 4,355,818 | A | 10/1982 | Watts | |
| 4,460,188 | A | 7/1984 | Maloof | |
| 4,575,109 | A | 3/1986 | Bowdery | |
| 4,795,186 | A | 1/1989 | Tyus | |
| 4,813,520 | A | 3/1989 | Lin | |
| 4,846,486 | A | 7/1989 | Hobson | |
| 4,886,286 | A | 12/1989 | Whorton, III | |
| 5,115,895 | A | 5/1992 | Myers | |
| 5,118,130 | A | 6/1992 | Kaltz | |
| 5,120,072 | A | 6/1992 | Laramie | |
| 5,197,754 | A | 3/1993 | Ward | |
| D334,640 | S | 4/1993 | Forish | |
| 5,203,815 | A | 4/1993 | Miller | |
| 5,244,225 | A | 9/1993 | Frycek | |
| D341,238 | S | 11/1993 | Sloan, III | |
| 5,265,892 | A | 11/1993 | Said | |
| 5,294,137 | A | 3/1994 | Barber et al. | |
| 5,295,565 | A | 3/1994 | Latshaw | |
| 5,318,315 | A | 6/1994 | White et al. | |
| 5,364,112 | A | 11/1994 | Jackson | |
| 5,364,120 | A | 11/1994 | Shimansky | |
| 5,374,073 | A | 12/1994 | Hung-Hsin | |
| D358,695 | S | 5/1995 | Hudson et al. | |
| 5,439,241 | A | 8/1995 | Nelson | |
| 5,445,398 | A | 8/1995 | Pierce | |
| 5,462,299 | A | 10/1995 | Maddux | |
| D374,773 | S | 10/1996 | Domotor | |
| 5,630,488 | A | 5/1997 | Chen | |
| 5,660,296 | A | 8/1997 | Greenwich | |
| 5,762,170 | A | 6/1998 | Shyr et al. | |
| 5,833,250 | A | 11/1998 | Schier et al. | |
| 5,836,601 | A | 11/1998 | Nelson | |
| 5,863,055 | A | 1/1999 | Kasravi et al. | |
| 5,887,878 | A | 3/1999 | Tisbo et al. | |
| D410,784 | S | 6/1999 | Sandford et al. | |
| 5,967,544 | A | 10/1999 | Kanta | |
| 5,988,657 | A | 11/1999 | Henkel | |
| 6,000,509 | A | 12/1999 | Chisholm | |
| 6,024,194 | A | 2/2000 | Chung-Hsien | |
| 6,059,079 | A | 5/2000 | Krulik | |
| 6,086,073 | A | 7/2000 | Tisbo | |
| 6,196,560 | B1 | 3/2001 | Ohlsson | |
| 6,220,610 | B1 | 4/2001 | Cox | |
| 6,328,329 | B1 | 12/2001 | Smith | |
| 6,345,830 | B1 | 2/2002 | Chavez | |
| 6,357,567 | B1 | 3/2002 | Tsai | |
| 6,362,736 | B1 | 3/2002 | Gehlot | |
| D456,973 | S | 5/2002 | Kimpel | |
| 6,382,736 | B1 * | 5/2002 | Chang | 301/111.05 |
| 6,386,557 | B1 | 5/2002 | Weldon | |
| 6,454,065 | B1 | 9/2002 | Chen | |
| 6,471,237 | B1 | 10/2002 | Bedsole | |
| 6,510,380 | B1 | 1/2003 | Curatolo et al. | |
| 6,520,514 | B2 | 2/2003 | Clegg | |
| 6,543,800 | B1 | 4/2003 | Doran | |
| 6,550,860 | B2 | 4/2003 | Lombardi | |
| 6,598,898 | B2 | 7/2003 | Chu | |
| 6,666,465 | B2 | 12/2003 | Chan | |
| 6,724,306 | B1 | 4/2004 | Parsley, Jr. et al. | |
| D489,507 | S | 5/2004 | Hahn | |
| 6,729,630 | B2 | 5/2004 | Szmidt et al. | |
| 6,769,701 | B1 * | 8/2004 | Clausen | 280/37 |
| 6,783,135 | B1 | 8/2004 | Nord | |
| 6,805,225 | B2 | 10/2004 | Freedman | |
| 6,814,361 | B2 * | 11/2004 | Tsu | 280/43.1 |
| 6,880,851 | B1 | 4/2005 | Summers et al. | |
| 6,929,275 | B1 | 8/2005 | Schlangen | |
| 6,955,365 | B2 | 10/2005 | Giampavolo et al. | |
| 6,964,420 | B1 | 11/2005 | Ghanizadeh et al. | |
| 7,015,814 | B2 | 3/2006 | Ireland et al. | |
| 7,040,635 | B1 | 5/2006 | Remole | |
| 7,066,311 | B2 * | 6/2006 | O'Shea | 190/18 A |
| 7,151,454 | B2 | 12/2006 | Washington | |
| 7,165,661 | B2 | 1/2007 | Miyoshi | |
| 7,168,713 | B2 | 1/2007 | Udall | |
| 7,196,621 | B2 | 3/2007 | Kochis | |
| 7,207,577 | B2 * | 4/2007 | Udall et al. | 280/47.26 |
| 7,219,902 | B1 | 5/2007 | Herold | |
| 7,523,949 | B1 | 4/2009 | Galfin | |
| 7,798,499 | B2 * | 9/2010 | Gregory | 280/43.1 |
| 8,172,241 | B2 | 5/2012 | Salvucci, Jr. | |
| 8,191,908 | B2 | 6/2012 | Udall et al. | |
| 8,317,205 | B2 | 11/2012 | Udall et al. | |
| 2002/0105156 | A1 | 8/2002 | Glidden | |
| 2002/0195782 | A1 | 12/2002 | Cates et al. | |
| 2003/0015858 | A1 | 1/2003 | Chu | |
| 2003/0034636 | A1 | 2/2003 | Ng | |
| 2003/0197340 | A1 | 10/2003 | Udall et al. | |
| 2004/0032102 | A1 | 2/2004 | Safari et al. | |
| 2005/0051981 | A1 | 3/2005 | Wallace et al. | |
| 2005/0098403 | A1 | 5/2005 | McIntyre | |
| 2005/0121275 | A1 | 6/2005 | Platte, III | |
| 2006/0087432 | A1 | 4/2006 | Corbett, Jr. | |
| 2007/0120336 | A1 | 5/2007 | Udall et al. | |
| 2007/0235964 | A1 | 10/2007 | Gregory | |

FOREIGN PATENT DOCUMENTS

| | | | |
|---|---|---|---|
| JP | 648482 | A | 2/1994 |
| JP | 11196920 | A | 7/1999 |
| JP | 2002177035 | A | 6/2002 |
| JP | 2004223093 | A | 8/2004 |
| JP | 3106076 | U | 10/2004 |
| JP | 3106863 | U | 11/2004 |
| JP | 2004344355 | A | 12/2004 |
| WO | 9846469 | A1 | 10/1998 |
| WO | 2004100699 | A1 | 11/2004 |
| WO | 2007149579 | A2 | 12/2007 |
| WO | 0194180 | A1 | 12/2011 |

* cited by examiner

MOBILE STORAGE UNIT WITH A RETRACTABLE WHEEL MECHANISM

FIELD OF THE INVENTION

The present invention relates to portable luggage and more particularly to a mobile storage unit with a retractable wheel mechanism.

BACKGROUND OF THE INVENTION

Backpacks are commonplace in use, for example, as a carrier to conveniently transport a student's books and belongings to school. The usual advantage is in supporting a substantial or inconvenient load on a user's torso, specifically the user's back, rather than the user's arms which would tire more quickly. It also frees up the user's arms for other use. FIG. 1 shows a typical backpack configuration. FIG. 1 shows a student 110 carrying a backpack 120.

The use of backpacks is steadily increasing amongst grade school students since many schools are being built with out lockers in order to stop vandalism and prevent students from hiding drugs or weapons. Since there are no lockers, students are forced to carry all of their belongings in a single backpack. Couple this with the fact that textbooks are getting bigger—some tip the scales at six pounds—and in increase in after school activities and the result is an increased amount of weight that students are carrying on their backs.

This extra burden that students are faced with can result in poor posture and back pain. Studies show that the average daily load carried by students is 20.5 lbs., with the maximum load reaching as much as 50 lbs. In fact, according to the U.S. Consumer Product Safety Commission, some 6,000 kids age 17 and under suffered backpack-related sprains and strains costing an average of $11,000 per injury.

SUMMARY OF THE INVENTION

A mobile storage unit with a retractable wheel mechanism is disclosed. The mobile storage unit comprises a rigid frame coupled with a top seat portion, a pair of wheels and a number of supports. The wheels are coupled to a wheel mechanism that retracts the wheels into a retracted position when a downward force is applied to the rigid frame (e.g. a user sits on the top seat portion) in an upright position. As a result, at least one supplemental support that is positioned above the ground when the pair of wheels are in the extended position, touches the ground when the pair of wheels is in the retracted position thereby adding support and stability to the mobile storage unit when in the upright position.

One aspect of the present application is directed to a mobile storage unit configured to operate at an angled position and an upright position. The mobile storage unit comprises a rigid frame, a pair of wheels coupled to the rigid frame and having an extended position and a retracted position, at least one wheel mechanism for retracting the pair of wheels into the retracted position when a downward force is applied to the rigid frame in an upright position and at least one supplemental support positioned above the ground when the pair of wheels are in the extended position, wherein the supplemental support touches the ground when the pair of wheels is in the retracted position. In some embodiments, the retraction of the pair of wheels by the wheel mechanism is automatic. In some embodiments, the wheel mechanism further comprises a biasing element for biasing the pair of wheels in the extended position. In some embodiments, the biasing element comprises a spring. Alternatively, the biasing element comprises a motor, a locking mechanism or a lever. The wheel mechanism further comprises a at least one sliding slot and corresponding sliding pin positioned within the sliding slot. In some embodiments, the sliding pin is coupled to one of the pair of wheels such that the one of the pair of wheels is only able to move with the sliding pin along the sliding slot. In some embodiments, the sliding slot is positioned such that when the mobile storage unit is in the angled position the sliding slot is substantially perpendicular to gravity. The rigid frame is coupled to a flexible storage bag. In some embodiments, the mobile storage unit further comprises a top seat portion coupled to the rigid frame and configured to sit on while the mobile storage unit is in the upright position. In some embodiments, at least one supplemental support is adjacent to one or both of the pair of wheels.

Another aspect of the present application is directed to a method of operating a mobile storage unit configured to operate at an angled position and an upright position comprising a rigid frame, a pair of wheels coupled to the rigid frame and having an extended position and a retracted position, at least one wheel mechanism for retracting the pair of wheels into the retracted position when a downward force is applied to the rigid frame in an upright position and at least one supplemental support positioned above the ground when the pair of wheels are in the extended position, wherein the supplemental support touches the ground when the pair of wheels is in the retracted position. The method comprises positioning the mobile storage unit in the upright position such that it is supported by the pair of wheels and one or more additional supports and providing the downward force to the rigid frame such that the pair of wheels are moved to the retracted position and the supplemental support provides further support for the mobile storage unit. In some embodiments, the method further comprises a top seat portion coupled to the rigid frame and configured to sit on while the mobile storage unit is in the upright position. The downward force is at least partially caused by a user sitting on the top seat portion. In some embodiments, the method further comprises removing the downward force from the rigid frame such that the pair of wheels automatically returns to the extended position. In some embodiments, the method further comprises positioning the mobile storage unit in the angled position such that the rigid frame is supported solely by the pair of wheels. The retraction of the pair of wheels by the wheel mechanism is automatic. In some embodiments, the wheel mechanism further comprises a biasing element for biasing the pair of wheels in the extended position. In some embodiments, the biasing element comprises a spring. Alternatively, the biasing element comprises a motor, a locking mechanism or a lever. In some embodiments, the wheel mechanism further comprises a at least one sliding slot and corresponding sliding pin positioned within the sliding slot. The sliding pin is coupled to one of the pair of wheels such that the one of the pair of wheels is only able to move with the sliding pin along the sliding slot. In some embodiments, the sliding slot is positioned such that when the mobile storage unit is in the angled position the sliding slot is substantially perpendicular to gravity. The rigid frame is coupled to a flexible storage bag. In some embodiments, the at least one supplemental support is adjacent to one or both of the pair of wheels.

In yet another aspect, the present application is directed to a mobile storage unit configured to operate at an angled position and an upright position. The mobile storage unit comprises a rigid frame coupled to one or more additional supports and one or more supplemental supports at or near a base portion of the rigid frame, wherein the additional and supplemental supports are substantially equal in length such that the mobile storage unit is substantially level when supported by the additional and supplemental supports in the upright position, a pair of wheels coupled with the rigid frame and having an extended position and a retracted position, wherein in the extended position the pair of wheels extend further from the rigid frame than the supplemental supports and at least one wheel mechanism comprising a spring, a sliding slot and a sliding pin, wherein the wheel mechanism automatically retracts the pair of wheels into the retracted position via the sliding slot and sliding pin when a downward force is applied to the rigid frame in an upright position, and further wherein the wheel mechanism automatically extends the pair of wheels into the extended position when the downward force is removed via the spring, wherein the one or more supplemental supports are positioned above the ground when the pair of wheels are in the extended position and touch the ground when the pair of wheels is in the retracted position. The at least one sliding pin is positioned within the sliding slot. The sliding pin is coupled to one of the pair of wheels such that the one of the pair of wheels is only able to move with the sliding pin along the sliding slot. In some embodiments, the sliding slot is positioned such that when the mobile storage unit is in the angled position the sliding slot is substantially perpendicular to gravity. The rigid frame is coupled to a flexible storage bag. In some embodiments, the mobile storage unit further comprises a top seat portion coupled to the rigid frame and configured to sit on while the mobile storage unit is in the upright position. In some embodiments, the one or more supplemental supports are adjacent to one or both of the pair of wheels.

In another aspect, the present application is directed to a wheel mechanism for use with a mobile storage unit having a rigid frame and configured to operate at an angled position and an upright position. The wheel mechanism comprises a body coupled to a base portion of the rigid frame, a pair of wheels coupled to the body and having an extended position and a retracted position, at least one retraction mechanism for retracting the pair of wheels into the retracted position when a downward force is applied to the body in an upright position and at least one supplemental support positioned above the ground when the pair of wheels are in the extended position, wherein the supplemental support touches the ground when the pair of wheels is in the retracted position. In some embodiments, the retraction of the pair of wheels by the retraction mechanism is automatic. The wheel mechanism further comprises a biasing element for biasing the pair of wheels in the extended position. In some embodiments, the biasing element comprises a spring. Alternatively, the biasing element comprises a motor, a locking mechanism or a lever. The body further comprises at least one sliding slot and corresponding sliding pin positioned within the sliding slot. In some embodiments, the sliding pin is coupled to one of the pair of wheels such that the one of the pair of wheels is only able to move with the sliding pin along the sliding slot. In some embodiments, the sliding slot is positioned such that when the wheel mechanism is in the angled position the sliding slot is substantially perpendicular to gravity. In some embodiments, the rigid frame is coupled to a flexible storage bag. The mobile storage unit further comprises a top seat portion coupled to the rigid frame and configured to sit on while the mobile storage unit is in the upright position. In some embodiments, the at least one supplemental support is adjacent to one or both of the pair of wheels.

DETAILED DESCRIPTION OF THE INVENTION

The present invention relates to a mobile storage unit. The following description is presented to enable one of ordinary skill in the art to make and use the invention and is provided in the context of a patent application and its requirements. Various modifications to the embodiments and the generic principals and features described herein will be readily apparent to those skilled in the art. Thus, the present invention is not intended to be limited to the embodiment shown but is to be accorded the widest scope consistent with the principles and features described herein.

Figure 1:
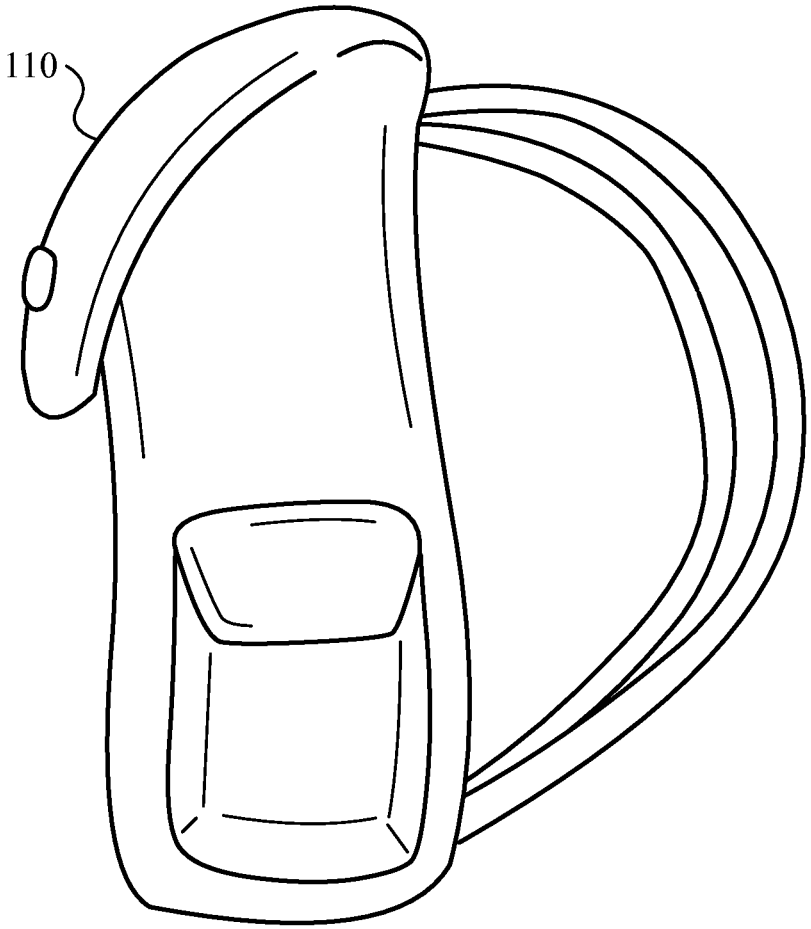
Fig. 1 (PRIOR ART)
FIG. 1 shows a typical backpack configuration.
Figure 2:
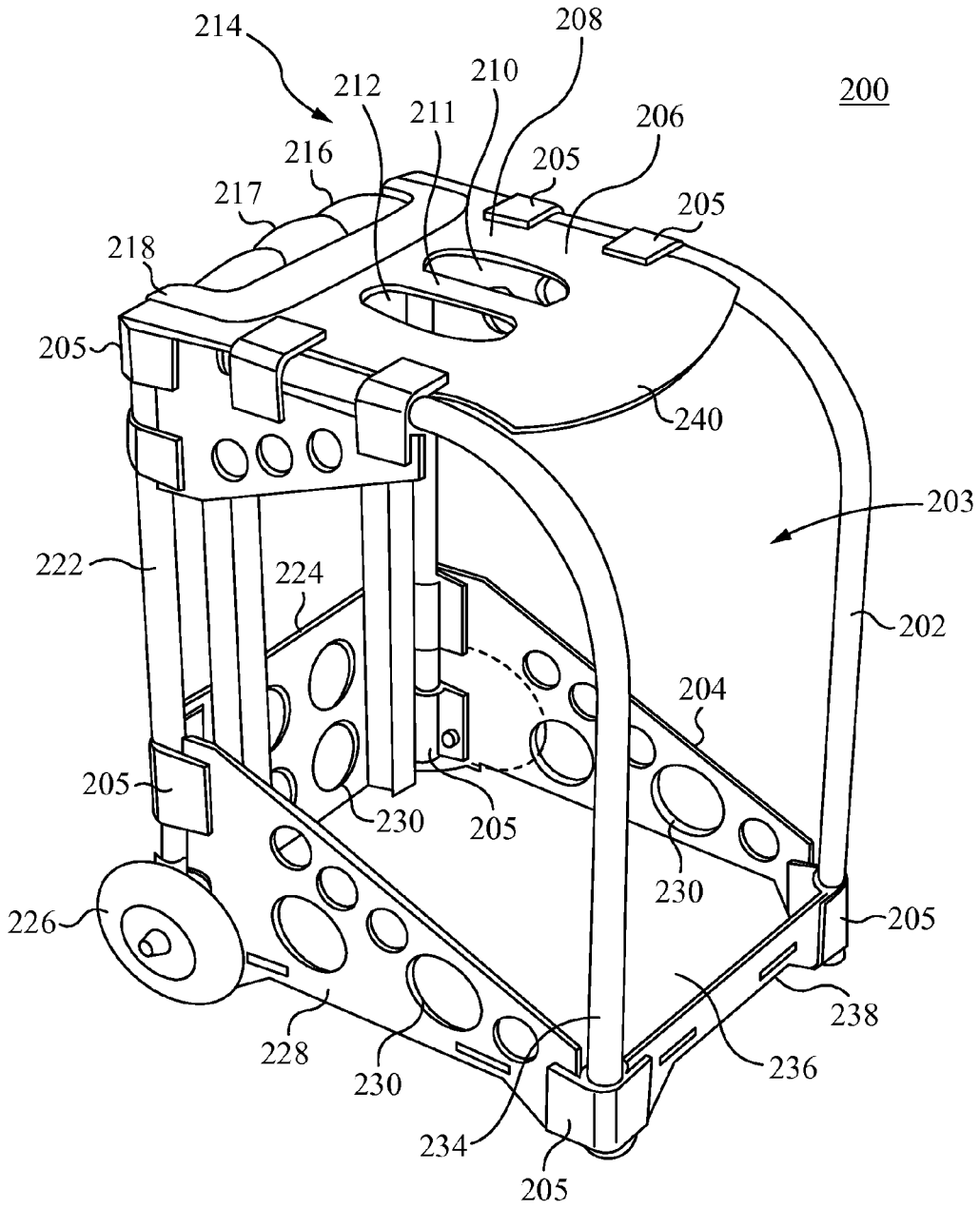
FIG. 2 shows one embodiment of the mobile storage unit.

FIG. 2 is an illustration of one embodiment of the mobile storage unit 200. The mobile storage unit 200 comprises first, second, third and fourth structural frames 202, 232, 222, 234, a seat portion 208, and a handle assembly 214. The mobile storage unit 200 also includes a right upper panel 206, a left upper panel 220, a right lower panel 204, a left lower panel 228, a back panel 224, a front panel 238, and a bottom panel 236. The mobile storage unit 200 further comprises two wheels 226, 227. The various components of the mobile storage unit 200 are interconnected via structural brackets 205. Accordingly the first structural frame 202 is coupled to the seat portion 204 via structural brackets 205. The first structural frame 202 is also coupled to the right upper panel 206, the right lower panel 204 and the front panel 236 via structural brackets 205. The handle assembly 214 is coupled to the seat portion 208. The second structural frame 232 is coupled to the right upper panel 2-6, the right lower panel 204 and the bottom panel 236 via structural brackets 205.

The third structural frame 222 is coupled to the left upper panel 220, the lower left panel 228 and the bottom panel 236. The fourth structural frame 234 is coupled to the seat portion 208, the right upper panel 220, the left lower panel 228, and the front panel 238 via structural brackets 205. The wheels 226, 227 are coupled to the right and left lower panels 204, 228 respectively via structural brackets 205.

The area below the seat portion 208 and above the bottom panel 238 defines a storage area 203. It is within this storage area 203 that a user can place articles such as textbooks, school materials, laptop computers, clothes, etc. It should be naturally understood that the storage area 203 should provide enough space to accommodate these materials, however the size of the storage area will depend on the dimensions and configurations of the various components (structural frames, panels, etc.) of the mobile storage unit 200. The structural frames 202, 232, 222, 234 are comprised of rigid structural tubing. The tubing could be comprised of aluminum, high strength plastic or any of a variety of structural rigid materials.

The structural brackets 205 are comprised of polished aluminum or high strength plastic, however it should be appreciated that any of a variety of materials could be utilized. The structural brackets 205 are attached to the various components of the mobile storage unit 200 via mechanical bolts or fasteners thereby providing rigidity to the mobile storage unit. It should be readily apparent though that the structural brackets could also be attached to the various components via a strong adhesive (high strength glue, epoxy, etc.) or a variety of other fastening means.

The seat portion 208 is coupled to the first and fourth structural frames 202, 234 via the structural brackets 205 and is designed to provide a "seat" for a user of the mobile storage unit 200. The seat portion 208 is designed to accommodate up to 600 lbs. and is comprised of a high strength rigid material such as a polycarbonate material, reinforced nylon, etc. Accordingly, a user sits on the seat portion 208 when the mobile storage unit is in an upright position (as shown in FIG. 2).

In addition to providing a seat for the user, the seat portion 208 also includes an integrated handle 211 whereby the integrated handle 211 can be utilized to pick up the mobile storage unit 200 with relative ease. The integrated handle 211 comprises two apertures 210, 212 in the seat portion 208 wherein the two apertures 210, 212 have a section of rigid material disposed there between. Accordingly, the section of rigid material disposed between the two apertures 210, 212 can be grasped by a user in order to pick up the mobile storage unit 200.

The seat portion 208 also includes a curved portion 240. The curved portion 240 is designed to provide lateral resistance to the rigid material that comprises the seat portion 208, thereby preventing the seat portion 208 from bending under the weight of user in situations where the mobile storage unit 200 is being utilized as a seat for the user.

Figure 3:
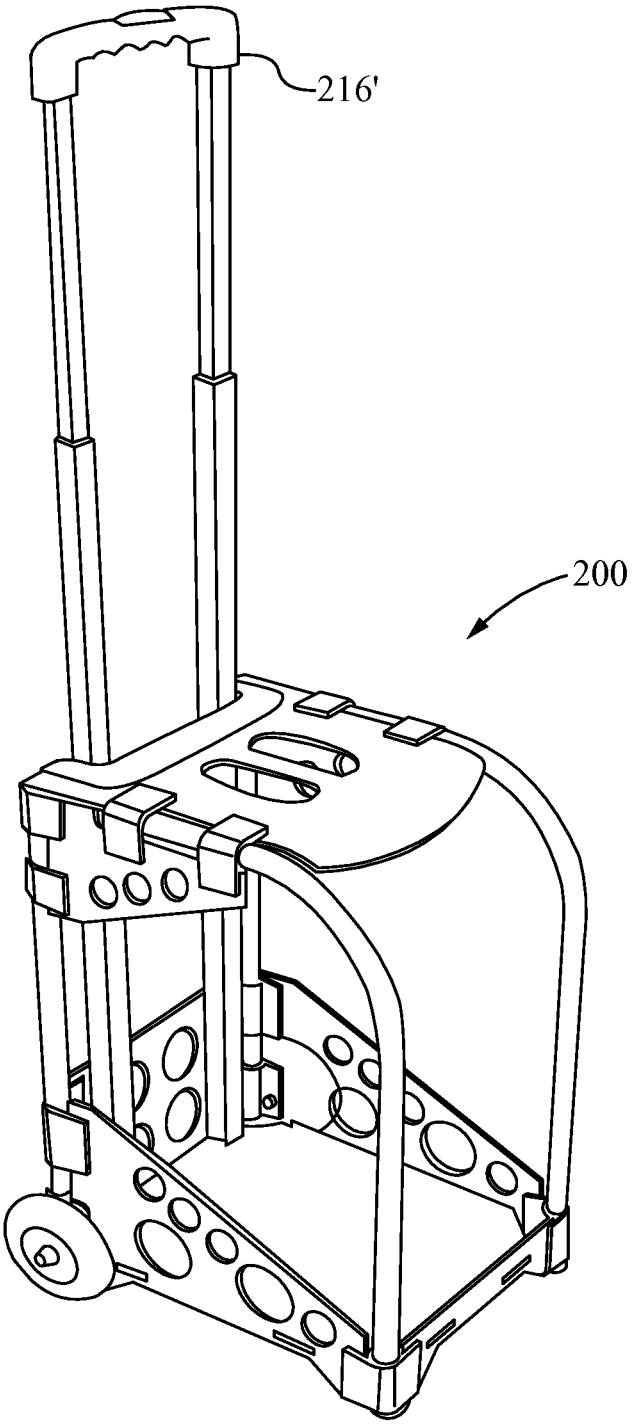
FIG. 3 shows the mobile storage unit wherein the handle is in a fully extended position.

The handle assembly 214 is coupled to the seat portion 208 and is comprised of a high strength plastic material. The handle assembly 214 comprises a handle tray 218 and an extendable/retractable handle 216 coupled to the handle tray 218. The handle tray 218 is coupled to the seat portion 208 via a strong adhesive compound or other suitable means. The handle 216, when in an extended position, is designed to be grasped by the user thereby allowing the user to pull and transport the mobile storage unit 200. For a better understanding, please see FIG. 3. FIG. 3 shows the mobile storage unit 200 wherein the handle 216, when in an extended position, is designed to be grasped by the user thereby allowing the user to pull and transport the mobile storage unit 200 wherein the handle 216' is in a fully extended position.

Please refer back to FIG. 2. The handle 216 includes a button 217. The button 217, when depressed, triggers a locking mechanism wherein the locking mechanism locks/unlocks the handle 216 when the handle 216 is in various extended positions. For example, if the user doesn't want to fully extend the handle 216, the user can extend the handle 216 at the desired extension and depress the button 217, thereby "locking" the handle 216 at the desired extension. A subsequent depression of the button 217 "unlocks" the handle 216 thereby allowing the user to extend/retract the handle 216 accordingly.

Although the some embodiments of the mobile storage unit are described as incorporating the above-described handle assembly, one of ordinary skill in the art will readily recognize that a variety of handle assemblies could by employed while remaining within the spirit and scope of the present invention. The upper and lower panels 204, 206, 220, 228, along with front and back panels 224, 238 are comprised of the same material as the seat portion 208 and are designed to add rigidity to the mobile storage unit 200. The panels includes holes 230 disposed therein. These holes 230 serve two purposes. First, they are incorporated to reduce the weight of the panels and thereby reduce the overall weight of the mobile storage unit 200. Additionally, the holes 230 in the upper panels 206, 220 and lower panels 204, 228 can be used to hold key rings and the like or to incorporate bungee cord or other articles.

The mobility of the mobile storage unit 200 is provided via the wheels 226, 227. A first wheel 227 is coupled to the lower right panel 204 and the second structural frame 232 via a structural bracket 205 and a second wheel 226 is coupled to the lower left panel 228 and the third structural frame 222 via a structural bracket 205. The wheels 226, 227 are at least 100 mm in diameter and can include LED lights to increase the visibility of mobile storage unit 200 when the mobile storage unit 200 is used at night or in similar dark surroundings.

Figure 4:
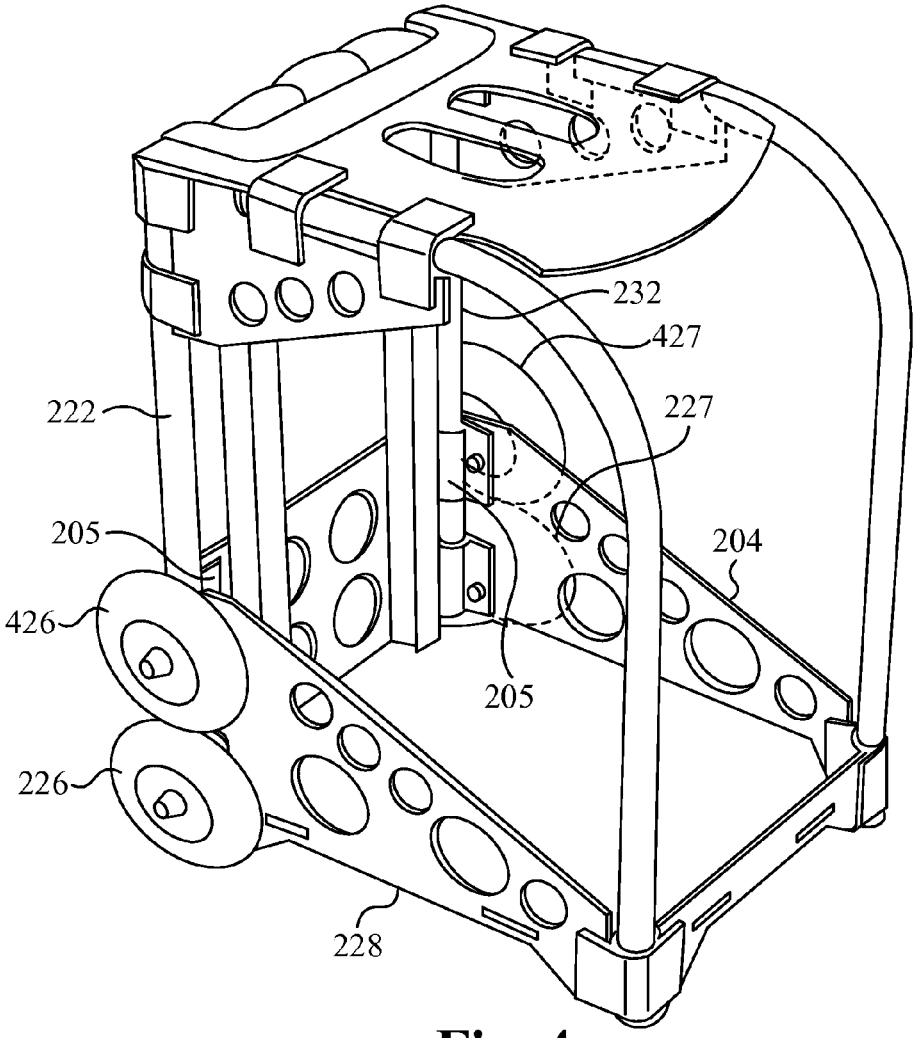
FIG. 4 shows an alternate embodiment of the mobile storage unit in accordance with some embodiments.

Although some embodiments of the mobile storage unit employ only two wheels, alternate embodiments are able to employ a third and fourth wheel. For a better understanding, please refer now to FIG. 4. FIG. 4 shows an alternate embodiment of the mobile storage unit in accordance with some embodiments. FIG. 4 shows a third wheel 427, located above the first wheel 227, coupled to the lower right panel 204 and the second structural frame 232 via a structural bracket 205 and the fourth wheel 426, located above the second wheel 226, coupled to the lower left panel 228 and the third structural frame 222 via a structural bracket 205.

The third and fourth wheels 426, 427 add convenience to the mobile storage unit 200 in that they enable the mobile storage unit to traverse curbs and stairs with less difficulty. For example, if the user is attempting to traverse a curb with the two-wheeled configuration, the second and third structural frames 222, 232 engage the curb surface first. Accordingly, in order to engage the first and second wheels 226, 227 with the curb surface, the user has to drag the mobile storage unit up the curb surface against the friction of the second and third structural frames 222, 232.

However, with the incorporation of the third and fourth wheels 426, 427, the third and fourth wheels 426, 427 will engage the curb surface first when the user attempts to traverse the curb. This allows the user to pull the mobile storage unit up the curb surface and subsequently engage the first and second wheels 226, 227 without the friction of the second and third structural frames 222, 232. This significantly decreases the burden that the user faces when traversing curbs and stairs with the mobile storage unit.

Figure 5:
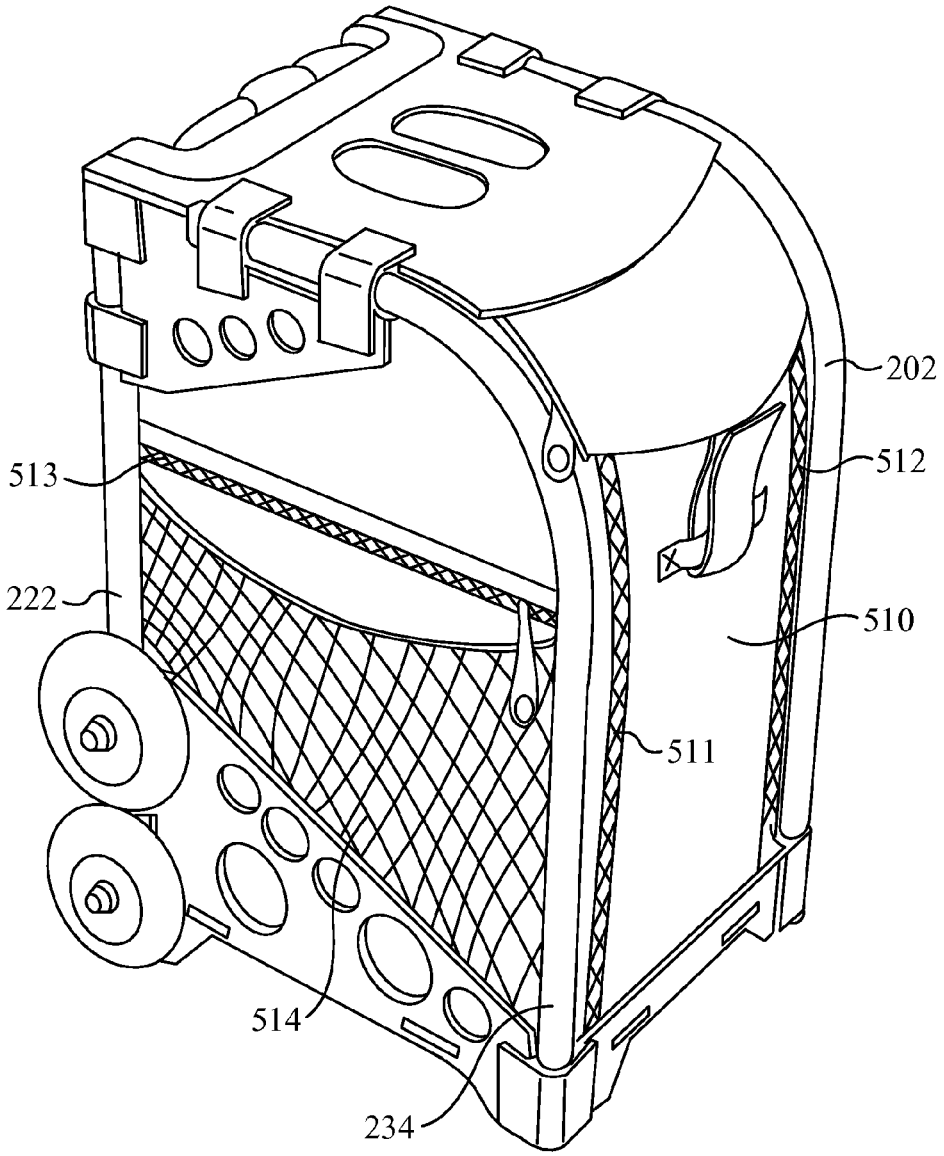
FIG. 5 in a view of the mobile storage unit in accordance with some embodiments being utilized in conjunction with a fabric material.

It is further contemplated that the mobile storage unit in accordance with some embodiments could be used in conjunction with case or bag comprised of a reinforced fabric material such as canvas. For a more detailed understanding, please refer now to FIG. 5. FIG. 5 is a perspective of the mobile storage unit in accordance with some embodiments being utilized in conjunction with the bag.

As can be seen in FIG. 5, the mobile storage unit includes a bag 510 wherein the bag is displaced within the storage area of the mobile storage unit. The bag 510 is coupled to any or all of the structural frames 202, 222, 234. The bag 510 is coupled to the respective structural frames utilizing a Velcro-type fastener or other suitable fastening means.

The bag 510 includes two lockable zippers 511, 512 wherein the bag 510 can be opened and closed thereby providing access to the storage space within the mobile storage unit. The bag 510 also includes a zipper 513 for providing access to the storage space within the mobile storage unit. Also shown is a side net pocket 514 that could be utilized to store pens, pencils, calculators, etc.

Although the above-described embodiment of the mobile storage unit is described as incorporating a reinforced fabric material such as canvas, one of ordinary skill in the art will readily appreciate that any of a variety of fabric materials could by employed in conjunction with the mobile storage unit while remaining within the spirit and scope of the present invention.

Figure 6:
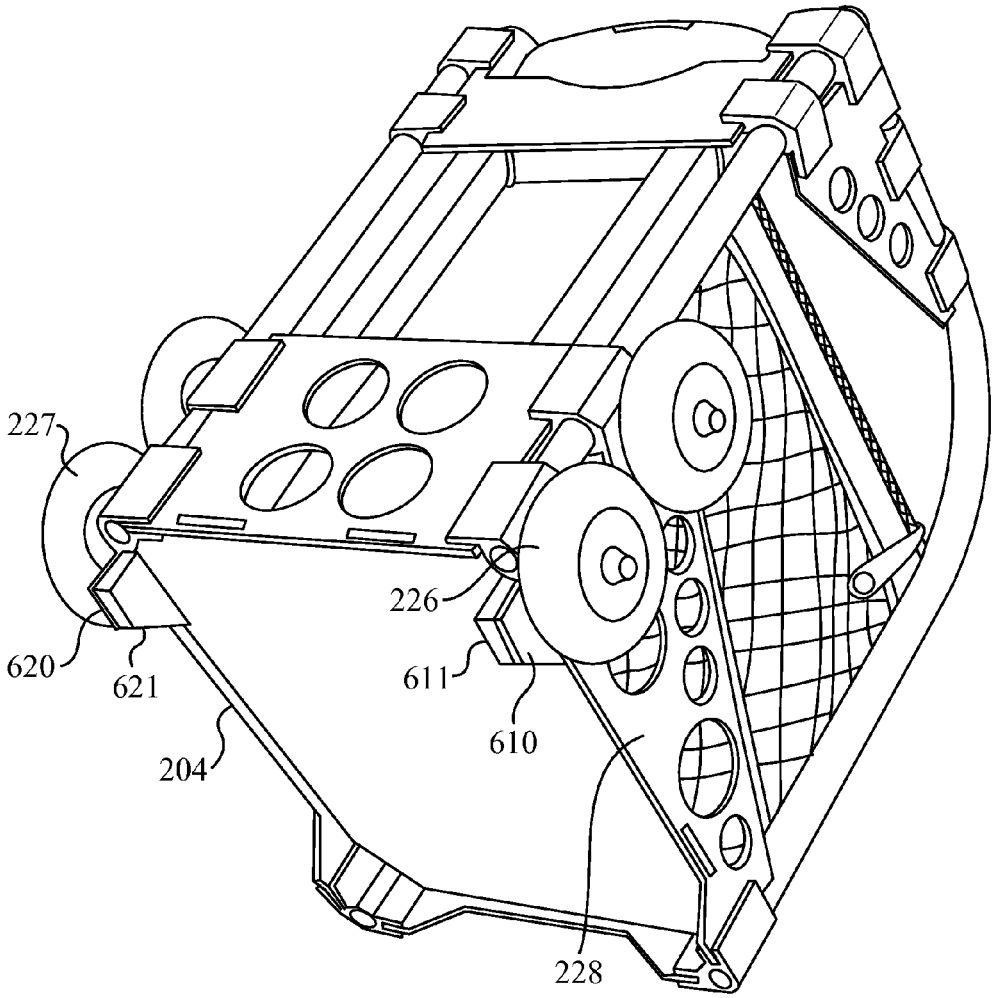
FIG. 6 shows yet another embodiment of the mobile storage unit in accordance with some embodiments.

A further objective is to provide braking means for the mobile storage unit in accordance with some embodiments. In some embodiments, the braking means comprise respective extensions of the lower left and right panels. For a better understanding, please refer now to FIG. 6. FIG. 6 shows a bottom perspective view of an alternate embodiment of the mobile storage unit in accordance with some embodiments. Shown in FIG. 6 are the respective extensions 610, 620 of the lower left and right panels 204, 228.

As can be seen, the respective extensions 610, 620 of the lower left and right panels extend beyond the first and second respective wheels 226, 227. Accordingly, when the mobile storage unit is being tilted to an upright position, the extensions 610, 620 engage the ground surface once the mobile storage unit reaches a tilt angle of between approximately 10°-20°. Once the extensions 610, 620 engage the ground surface, they provide friction against the ground surface thereby enabling a user to bring the mobile storage unit to an upright position in a more controlled fashion. In some embodiments, rubber attachments 611, 621 are also included to decrease the wear on the respective extensions 610, 620.

Additionally, the extensions 610, 620 provide added stability when the mobile storage unit in is an upright position. For example, if the mobile storage unit is in an upright position and is being utilized as a seat, the extensions 610, 620 are in contact with the ground surface and not the respective first and second wheels 226, 227. This prevents the wheels 226, 227 from engaging with the ground surface thereby causing the mobile storage unit to slip and roll out from under the person sitting on it.

Although some embodiments of the mobile storage unit have been described as being utilized in conjunction with the above-described braking means, one of ordinary skill in the art will readily recognize that a variety of braking means could be utilized in conjunction with the mobile storage unit while remaining within the spirit and scope of the present invention. For example, a spring loaded braking system that is activated based on weight displacement (e.g. a person sitting on the seat) could be employed.

Figure 7:
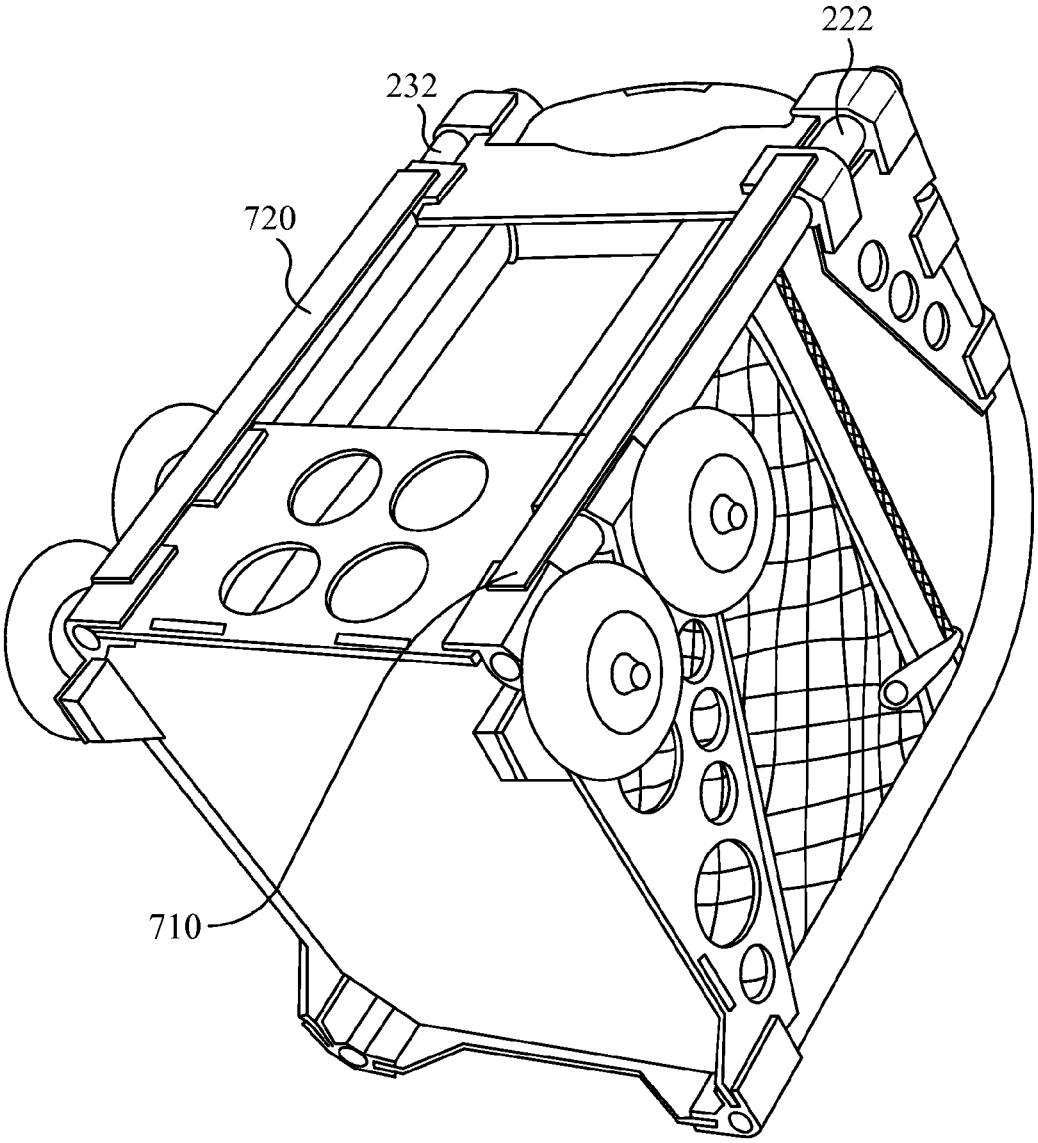
FIG. 7 shows an alternate embodiment of the mobile storage unit in accordance with some embodiments.

An additional feature that may be incorporated with the mobile storage unit are grinding rails. For a better understanding please refer to FIG. 7. FIG. 7 shows a bottom perspective view of the mobile storage unit in accordance with some embodiments. As can be seen in FIG. 7, two grinding rails 710, 720 are coupled to the back of the mobile storage unit. In some embodiments, the grinding rails 710, 720 are comprised of a hard plastic or metal material and provide protection for the second and third structural frames 222, 232 when the mobile storage unit is being utilized to traverse unusually high curbs and/or stairs.

Figure 9:
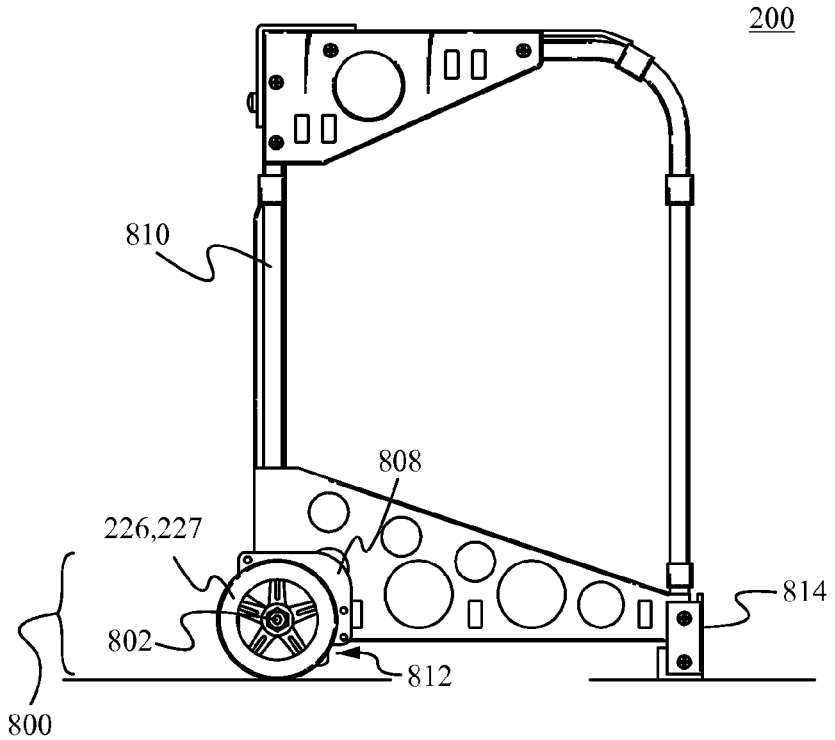
FIG. 9 shows a side view of the wheel mechanism in the extended position as a part of the mobile storage unit in accordance with some embodiments.
Figure 10:
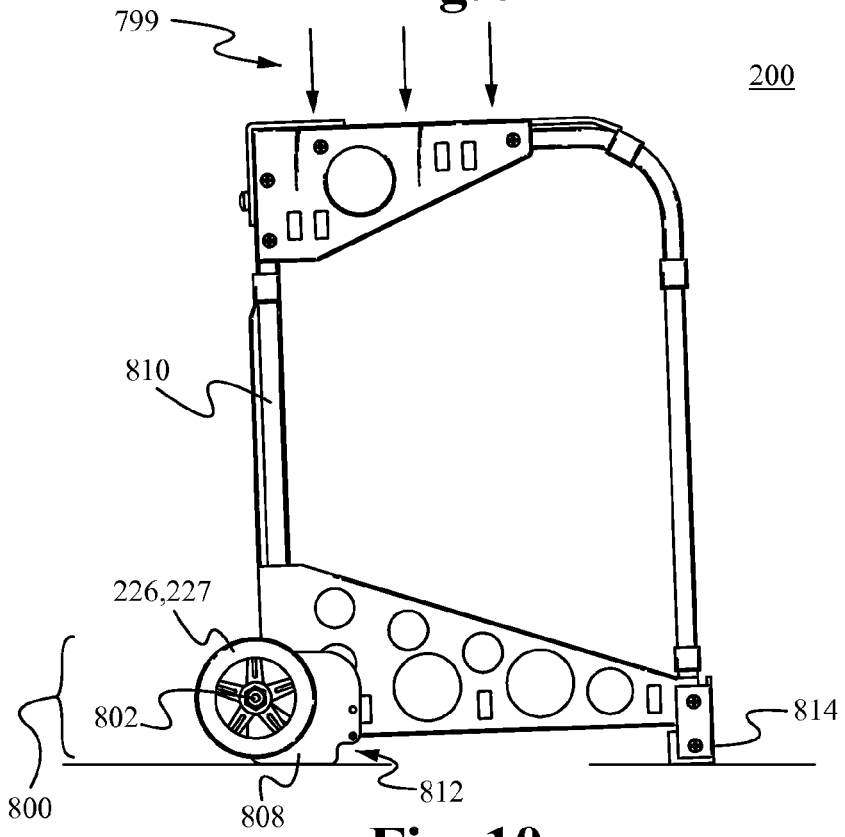
FIG. 10 shows a side view of the wheel mechanism in the retracted position in accordance with some embodiments.

In some embodiments as shown in FIGS. 8A-8D, the mobile storage unit 200 (not shown) further comprises one or more wheel mechanisms 800. The wheel mechanisms 800 are coupled to the frame 810 of the mobile storage unit 200 as shown in FIGS. 9 and 10. The wheel mechanisms 800 comprise a body plate 808 having a sliding slot 804 and a support member 812, a sliding pin 802 and a biasing element 806. The sliding pin 802 is coupled to one or more of the wheels 223, 227 and positioned within the sliding slot 804. In some embodiments, the sliding slot 804 creates an aperture through the body plate 808. Alternatively, the sliding slot 804 does not go through the body plate 808, instead forming a channel within the body plate 808. The biasing element 806 is coupled to the body plate 808 and the sliding pin 802. The support member 812 is positioned such that the member 812 protrudes downward away from the frame 810 of the storage unit 200. In some embodiments, the support member 812 is a protruding portion of the body plate 808 itself. Alternatively, the support member 812 is a separate element that is coupled with the body plate 808. In some embodiments, the body plate 808, support member 812 and sliding pin 802 comprise a metal, hard plastic or combination thereof. Alternatively, the body plate 808, support member 812 and/or sliding pin 802 are able to comprise any material able to withstand the weight of a person seated on the storage unit 200 along with the weight of the storage unit itself and the contents within the storage unit. In some embodiments, the biasing element 806 is a spring. Alternatively, the biasing element is a motor, lever, locking mechanism or other device capable of biasing the position of the sliding pin 802 within the sliding slot 804. In some embodiments, the support member 812 comprises a rubber friction pad for increasing friction with the ground. Alternatively, other types of material with a greater friction coefficient than the support member 812 itself are able to be used for the friction pad as are well known in the art. In some embodiments, each wheel 226, 227 has an individual wheel mechanism 800. Alternatively, a plurality of wheels 226, 227 are able to correspond to a single wheel mechanism 800.

Figure 8A:
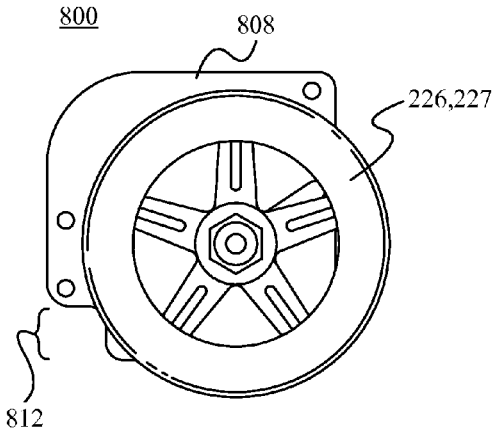
FIG. 8A shows a front view of the wheel mechanism in an extended position in accordance with some embodiments.
Figure 8B:
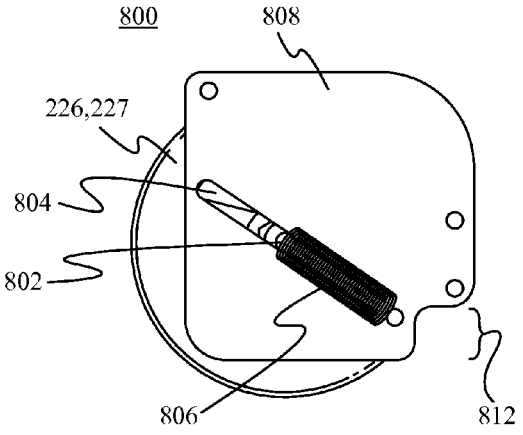
FIG. 8B shows a back view of the wheel mechanism in an extended position in accordance with some embodiments.
Figure 8C:
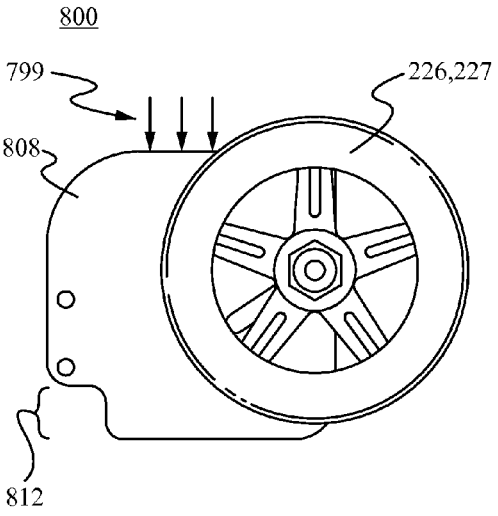
FIG. 8C shows a front view of the wheel mechanism in a retracted position in accordance with some embodiments.
Figure 8D:
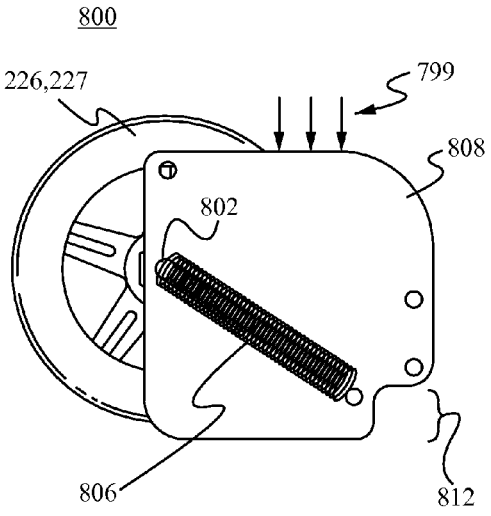
FIG. 8D shows a back view of the wheel mechanism in a retracted position in accordance with some embodiments.

In operation, the wheel mechanism 800 allows the wheels 226, 227 to move between an extended position (FIGS. 8A, 8B and 9) and a retracted position (FIGS. 8C, 8D and 10). Specifically, the sliding slot 804 is angled such that when a downward force 799 is applied to the wheel mechanism 800 the sliding pin 802 and corresponding wheel 226, 227 automatically slides up the sliding slot 804 until the sliding pin 802 reaches the end of the sliding slot 804 and the wheels 226, 227 are in the retracted position. In the embodiment illustrated in FIGS. 9 and 10, the downward force 799 must be greater than the biasing force of the biasing element 806 in order for the wheels 226, 227 to move to the retracted position. This is because the biasing element 806 is positioned such that it biases the sliding pin 802 into the extended position on the opposite end of the sliding slot 804. Alternatively, in some embodiments, the biasing element 806 biases the sliding pin 802 and corresponding wheel 226, 227 in the retracted position until there is a greater downward force on the wheel 226, 227 such as when the mobile storage unit 200 is in the angled position and thus the weight of the mobile storage unit 200 is applied to the wheels 226, 227 causing the wheels 226, 227 to automatically move to the extended position. In other embodiments, the wheels 226, 227 must be manually moved between the extended and retracted positions by a user. As the wheels 226, 227 are moved in such a manual embodiment, the wheels 226, 227 are able to be locked into the extended or retracted position by a locking mechanism in place of the biasing element 806.

When the downward force 799 is removed from the wheel mechanism 800, the wheels 226, 227 and sliding pin 802 automatically return to the extended position due to the force of the biasing element 806. In some embodiments, the sliding slot 804 is positioned such that the slot 804 remains substantially perpendicular to gravity when the mobile storage unit 200 is in an angled position for transport. As a result, any downward or gravitational force experienced by the wheel mechanism 800 in the tilted position does not align with the sliding slot 804 and consequently, the wheels 226, 227 and corresponding sliding pin 802 will remain in the extended position. In some embodiments, the angled position of the wheel mechanism 800 and mobile storage unit 200 is between 30 and 60 degrees from the ground. Alternatively, any angle between 1 and 89 degrees from the ground is contemplated.

As shown in FIGS. 9 and 10, the wheel mechanisms 800 are coupled at or near the bottom of the frame 810 of the mobile storage device 200. Alternatively, the wheel mechanisms 800 are integrated into the frame 810 itself. As illustrated, the wheel mechanisms 800 are positioned across from the front supports 814. Alternatively, the wheel mechanisms 800 are able to be positioned anywhere along the frame 810. In some embodiments, the supporting member 812 of the wheel mechanisms 800 is substantially equal in length to the front supports 814 such that when the mobile storage device 200 is supported by the front supports 814 and the supporting members 812, the mobile storage device 200 is substantially level to the ground. Alternatively, one skilled in the art would understand that the size and shape of the supporting member 812 is able to be varied in many ways as long as the supporting member 812 maintains the ability to support the mobile storage unit 200 without interfering with the operation of the wheels 226, 227 when the unit 200 is being transported. In some embodiments, each wheel mechanism 800 has an individual supporting member 812. Alternatively, one or more wheel mechanisms 800 are able to share a single supporting member. As described above, the supporting member 812 is able to be a separate from or a portion of the body plate 808. In some embodiments, a single wheel mechanism 800 is able to have a plurality of supporting members 812.

The operation of the mobile storage unit 200 comprising the wheel mechanisms 800 is similar to the operation of the wheel mechanisms 800 described above with reference to FIGS. 8A-8D except that the downward force 799 is applied to the mobile storage unit 200 as a whole. Specifically, while in an upright position, the wheel mechanism 800 maintains the wheels 226, 227 in an extended position as shown in FIG. 9 such that the wheels 226, 227 and the front supports 814 provide the contacts with the ground that support the weight of the mobile storage unit 200. When the downward force 799 is then applied to the mobile storage unit 200, the wheel mechanism 800 automatically retracts the wheels 226, 227 into a retracted position as shown in FIG. 10 such that the support members 812 contact the ground and along with the front supports 814 provide support for the weight of the storage unit 200. When the downward force 799 is subsequently removed, the wheel mechanism 800 automatically extends the wheels 226, 227 to the extended position as shown in FIG. 9 such that the mobile storage unit 200 is ready to be moved to an angled position and rolled along the wheels 226, 227. As a result, when a user sits on the mobile storage unit 200, instead of relying on the unstable movable wheels 226, 227 for support on one side, the mobile storage unit 200 provides stable support opposite the front supports 812 in the form of the support members 812. Accordingly, a user of the mobile storage unit 200 is able to safely sit on the mobile storage unit 200 without worrying about leaning too far back such that the wheels 226, 227 begin to roll and the unit 200 falls over. Further, the user is still able to stand up and gain the benefit of the automatically extending wheels 226, 227 for ease of transport.

In some embodiments, the wheels 226, 227 are still in contact with the ground and provide additional support when in the retracted position. Alternatively, the wheels 226, 227 in the retracted position are sufficiently retracted such that the wheels 226, 227 do not contact the ground in the retracted position. In some embodiments, the wheel mechanism 800 automatically retracts the wheels 226, 227 into the retracted position whenever the mobile storage unit 200 is in the upright position even if no downward force 799 is applied to the frame 810. Alternatively, in some embodiments, as described above, the wheels 226, 227 need to be manually moved by a user from the extended position to the retracted position and vice versa.

Figure 11:
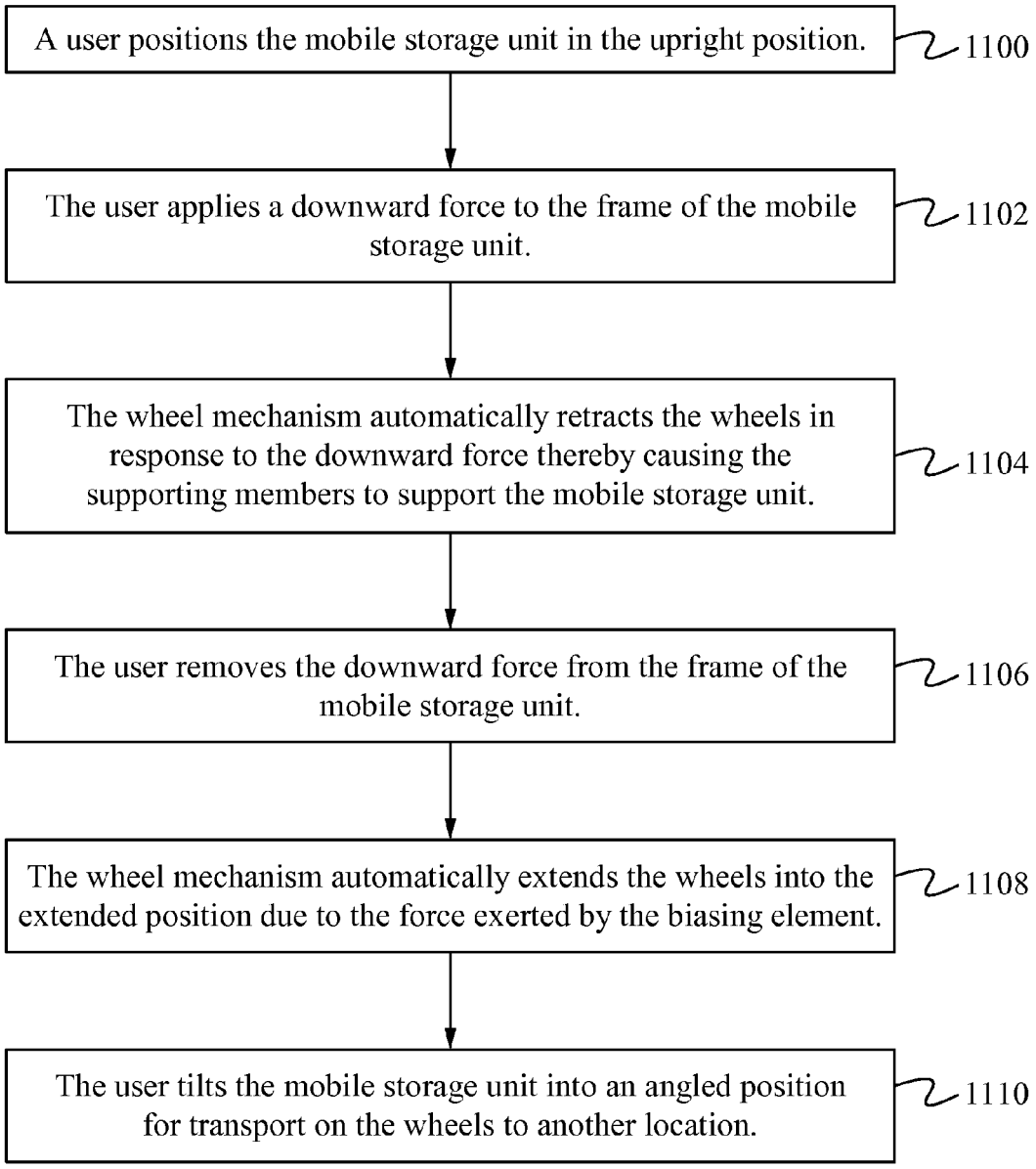
FIG. 11 shows a flow chart of the operation of the mobile storage unit with a wheel mechanism in accordance with some embodiments.

The mobile storage unit 200 with one or more wheel mechanisms 800 will now be discussed in conjunction with a flow chart illustrated in FIG. 11. In operation, as shown in FIGS. 9 and 10, a user positions the mobile storage unit 200 in the upright position at the step 1100. The user applies a downward force 799 to the frame 810 of the mobile storage unit 200 at the step 1102. For example, the user may sit on the top seat portion (not shown) of the mobile storage unit 200 thereby causing the downward force 799 due to the weight of the user. The wheel mechanism 800 automatically retracts the wheels 226, 227 in response to the downward force thereby causing the supporting members 812 to support the mobile storage unit 200 at the step 1104. In some embodiments, the wheel mechanism 800 automatically retracts the wheels 226, 227 in response to the mobile storage unit 200 being positioned in an upright position despite the lack of an additional downward force 799. Alternatively, the user manually retracts the wheels 226, 227 into the retracted position. The user removes the downward force 799 from the frame 810 of the mobile storage unit 200 at the step 1106. The wheel mechanism 800 automatically extends the wheels 226, 227 into the extended position due to the force exerted by the biasing element 806 at the step 1108. In some embodiments, the wheel mechanism 800 extends the wheels 226, 227 in response to the tilting of the mobile storage unit 200, but remains in the contracted position while in the mobile storage unit 100 is in the upright position. Alternatively, the user manually extends the wheels 226, 227 into the extended position. The user tilts the mobile storage unit 200 into an angled/tilted position for transport on the wheels 226, 227 to another location at the step 1110.

The mobile storage unit described herein has numerous advantages. The mobile storage unit incorporates a seat portion which allows a user to utilize the mobile storage unit as a seat in situations where on is needed yet not available. Additionally, the wheel mechanism of the mobile storage unit allows the unit to be significantly more stable as a seating unit than when the wheels themselves provide part of the seated support. In particular, the mobile storage unit has the advantage that the wheel mechanism automatically retracts when in an upright position in order to allow the more stable support to fully support the weight of the unit and any users sitting on the top seat portion of the unit. Further, the wheel mechanism automatically extends the wheels into a position for rolling the storage unit when a user puts the unit in the angled position. Accordingly, the mobile storage unit successfully provides the advantages of wheeled storage while simultaneously providing a safe and stable seat for use when the unit is in an upright position.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A mobile storage unit configured to operate at an angled position and an upright position comprising:

a. a rigid frame;

b. a pair of wheels coupled to the rigid frame and having an extended position and a retracted position;

c. at least one wheel mechanism for retracting the pair of wheels into the retracted position when a downward force is applied to the rigid frame in an upright position, wherein the wheel mechanism further comprises a pair of biasing elements, each of the pair of biasing elements coupled to a respective one of the pair of wheels for automatically biasing the pair of wheels in the extended position by pulling the pair of wheels in a direction away from a top of the rigid frame such that at least a portion of each of the pair of wheels is below the rigid frame thereby allowing the wheels to roll under the rigid frame; and d. at least one supplemental support positioned above the ground when the pair of wheels are in the extended position, wherein the supplemental support touches the ground when the pair of wheels is in the retracted position.

2. The mobile storage unit of claim 1, wherein the retraction of the pair of wheels by the wheel mechanism is automatic.

3. The mobile storage unit of claim 1, wherein the biasing element comprises a spring.

4. The mobile storage unit of claim 1, wherein the wheel mechanism further comprises at least one sliding slot and corresponding sliding pin positioned within the sliding slot.

5. The mobile storage unit of claim 4, wherein the sliding pin is coupled to one of the pair of wheels such that the one of the pair of wheels is only able to move with the sliding pin along the sliding slot.

6. The mobile storage unit of claim 5, wherein the sliding slot is positioned such that when the mobile storage unit is in the angled position the sliding slot is substantially perpendicular to gravity.

7. The mobile storage unit of claim 1, wherein the rigid frame is coupled to a flexible storage bag.

8. The mobile storage unit of claim 7, further comprising a top seat portion coupled to the rigid frame and configured to sit on while the mobile storage unit is in the upright position.

9. The mobile storage unit of claim 8, wherein the at least one supplemental support is adjacent to one or both of the pair of wheels.

10. A method of operating a mobile storage unit configured to operate at an angled position and an upright position comprising a rigid frame, a pair of wheels coupled to the rigid frame and having an extended position and a retracted position, at least one wheel mechanism for retracting the pair of wheels into the retracted position when a downward force is applied to the rigid frame in an upright position, wherein the wheel mechanism further comprises a pair of biasing elements, each of the pair of biasing elements coupled to a respective one of the pair of wheels for automatically biasing the pair of wheels in the extended position by pulling the pair of wheels in a direction away from a top of the rigid frame such that at least a portion of each of the pair of wheels is below the rigid frame thereby allowing the wheels to roll under the rigid frame, and at least one supplemental support positioned above the ground when the pair of wheels are in the extended position, wherein the supplemental support touches the ground when the pair of wheels is in the retracted position, the method comprising:

a. positioning the mobile storage unit in the upright position such that it is supported by the pair of wheels and one or more additional supports; and b. providing the downward force to the rigid frame such that the pair of wheels are moved to the retracted position and the supplemental support provides further support for the mobile storage unit.

11. The method of claim 10, further comprising a top seat portion coupled to the rigid frame and configured to sit on while the mobile storage unit is in the upright position.

12. The method of claim 11, wherein the downward force is at least partially caused by a user sitting on the top seat portion.

13. The method of claim 10, further comprising removing the downward force from the rigid frame such that the pair of wheels automatically returns to the extended position.

14. The method of claim 13, further comprising positioning the mobile storage unit in the angled position such that the rigid frame is supported solely by the pair of wheels.

15. The method of claim 10, wherein the retraction of the pair of wheels by the wheel mechanism is automatic.

16. The method of claim 10, wherein the biasing element comprises a spring.

17. The method of claim 10, wherein the wheel mechanism further comprises at least one sliding slot and corresponding sliding pin positioned within the sliding slot.

18. The method of claim 17, wherein the sliding pin is coupled to one of the pair of wheels such that the one of the pair of wheels is only able to move with the sliding pin along the sliding slot.

19. The method of claim 18, wherein the sliding slot is positioned such that when the mobile storage unit is in the angled position the sliding slot is substantially perpendicular to gravity.

20. The method of claim 10, wherein the rigid frame is coupled to a flexible storage bag.

21. The method of claim 10, wherein the at least one supplemental support is adjacent to one or both of the pair of wheels.

22. A mobile storage unit configured to operate at an angled position and an upright position comprising:

a. a rigid frame coupled to one or more additional supports and one or more supplemental supports at or near a base portion of the rigid frame, wherein the additional and supplemental supports are substantially equal in length such that the mobile storage unit is substantially level when supported by the additional and supplemental supports in the upright position;

b. a pair of wheels coupled with the rigid frame and having an extended position and a retracted position, wherein in the extended position the pair of wheels extend further from the rigid frame than the supplemental supports; and c. a pair of wheel mechanisms, each comprising a spring, a sliding slot and a sliding pin, wherein the pair of wheel mechanisms automatically retract the pair of wheels into the retracted position via the sliding slot and sliding pin when a downward force is applied to the rigid frame in an upright position, and further wherein the pair of wheel mechanisms comprises a pair of biasing elements, each of the pair of biasing elements coupled to a corresponding one of the sliding pins for automatically extending the pair of wheels into the extended position when the downward force is removed via the spring;

wherein the one or more supplemental supports are positioned above the ground when the pair of wheels are in the extended position and touch the ground when the pair of wheels is in the retracted position.

23. The mobile storage unit of claim 22, wherein the at least one sliding pin is positioned within the sliding slot.

24. The mobile storage unit of claim 23, wherein the sliding pin is coupled to one of the pair of wheels such that the one of the pair of wheels is only able to move with the sliding pin along the sliding slot.

25. The mobile storage unit of claim 24, wherein the sliding slot is positioned such that when the mobile storage unit is in the angled position the sliding slot is substantially perpendicular to gravity.

26. The mobile storage unit of claim 22, wherein the rigid frame is coupled to a flexible storage bag.

27. The mobile storage unit of claim 26, further comprising a top seat portion coupled to the rigid frame and configured to sit on while the mobile storage unit is in the upright position.

28. The mobile storage unit of claim 27, wherein the one or more supplemental supports are adjacent to one or both of the pair of wheels.

29. A wheel mechanism for use with a mobile storage unit having a rigid frame and configured to operate at an angled position and an upright position, the wheel mechanism comprising:

a. a body coupled to a base portion of the rigid frame;

b. a pair of wheels coupled to the body and having an extended position and a retracted position;

c. a pair of retraction mechanisms for retracting the pair of wheels into the retracted position when a downward force is applied to the body in an upright position;

d. a pair of biasing elements, each of the pair of biasing elements coupled to a respective one of the pair of wheels for automatically biasing the pair of wheels in the extended position by pulling the pair of wheels in a direction away from a top of the rigid frame such that at least a portion of each of the pair of wheels is below the rigid frame thereby allowing the wheels to roll under the rigid frame; and e. at least one supplemental support positioned above the ground when the pair of wheels are in the extended position, wherein the supplemental support touches the ground when the pair of wheels is in the retracted position.

30. The wheel mechanism of claim 29, wherein the retraction of the pair of wheels by the retraction mechanism is automatic.

31. The wheel mechanism of claim 29, wherein each of the pair of biasing elements comprises a spring.

32. The wheel mechanism of claim 29, wherein the body further comprises at least one sliding slot and corresponding sliding pin positioned within the sliding slot.

33. The wheel mechanism of claim 32, wherein the sliding pin is coupled to one of the pair of wheels such that the one of the pair of wheels is only able to move with the sliding pin along the sliding slot.

34. The wheel mechanism of claim 33, wherein the sliding slot is positioned such that when the wheel mechanism is in the angled position the sliding slot is substantially perpendicular to gravity.

35. The wheel mechanism of claim 29, wherein the rigid frame is coupled to a flexible storage bag.

36. The wheel mechanism of claim 35, wherein the mobile storage unit further comprises a top seat portion coupled to the rigid frame and configured to sit on while the mobile storage unit is in the upright position.

37. The wheel mechanism of claim 36, wherein the at least one supplemental support is adjacent to one or both of the pair of wheels.

38. A mobile storage unit configured to operate at an angled position and an upright position comprising:

a. a rigid frame;

b. a pair of wheels coupled to the rigid frame and having an extended position and a retracted position;

c. at least one wheel mechanism for retracting the pair of wheels into the retracted position when a downward force is applied to the rigid frame in an upright position, wherein the wheel mechanism further comprises a pair of biasing elements, and a pair of sliding slots each with a corresponding sliding pin coupled to a respective one of the pair of wheels such that the one of the pair of wheels is only able to move with the sliding pin along the sliding slot, each of the pair of biasing elements directly coupled to a respective sliding pin for automatically biasing the pair of wheels in the extended position; and d. at least one supplemental support positioned above the ground when the pair of wheels are in the extended position, wherein the supplemental support touches the ground when the pair of wheels is in the retracted position.

* * * * *